US007164407B2

(12) United States Patent
Matsuyama

(10) Patent No.: US 7,164,407 B2
(45) Date of Patent: Jan. 16, 2007

(54) DRIVER FOR DRIVING A LIQUID CRYSTAL DISPLAY AND METHOD OF DRIVING THE SAME

(75) Inventor: Shigeru Matsuyama, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 569 days.

(21) Appl. No.: 10/736,229

(22) Filed: Dec. 15, 2003

(65) Prior Publication Data

US 2004/0196246 A1 Oct. 7, 2004

(30) Foreign Application Priority Data

Dec. 20, 2002 (JP) ..... 2002-370054

(51) Int. Cl.
*G09G 3/36* (2006.01)

(52) U.S. Cl. ..... 345/98; 345/87; 345/100; 345/104

(58) Field of Classification Search ..... 345/87, 345/98–100, 104, 204, 211–213
See application file for complete search history.

(56) References Cited

U.S. PATENT DOCUMENTS

| | | | | |
|---|---|---|---|---|
| 6,104,370 | A * | 8/2000 | Nakagaki et al. | 345/100 |
| 6,304,241 | B1 * | 10/2001 | Udo et al. | 345/96 |
| 6,462,725 | B1 * | 10/2002 | Orisaka | 345/98 |
| 6,747,641 | B1 * | 6/2004 | Nakamura et al. | 345/213 |
| 6,791,539 | B1 * | 9/2004 | Nakajima et al. | 345/204 |
| 6,795,051 | B1 * | 9/2004 | Ikeda | 345/100 |
| 6,876,365 | B1 * | 4/2005 | Tsutsui et al. | 345/536 |
| 6,940,479 | B1 * | 9/2005 | Kanbe et al. | 345/87 |
| 2001/0043187 | A1 * | 11/2001 | Ikeda | 345/100 |
| 2002/0063674 | A1 * | 5/2002 | Chiang | 345/98 |
| 2002/0063676 | A1 * | 5/2002 | Murade et al. | 345/100 |

FOREIGN PATENT DOCUMENTS

| | | |
|---|---|---|
| JP | 05-143024 | 6/1993 |
| JP | 06-059241 | 3/1994 |
| JP | 08-006525 | 1/1996 |
| JP | 08-329696 | 12/1996 |
| JP | 10-340068 | 12/1998 |
| JP | 2001-166727 | 6/2001 |
| JP | 2002-040979 | 2/2002 |

(Continued)

*Primary Examiner*—Richard Hjerpe
*Assistant Examiner*—Kimnhung Nguyen
(74) *Attorney, Agent, or Firm*—Hogan & Hartson LLP

(57) ABSTRACT

A driver for driving a liquid crystal display includes an input terminal that inputs input data, an output terminal that outputs output data, a bi-directional common driver equipped with a first input/output terminal and a second input/output terminal and an input/output relationship of the first input/output terminal and the second input/output terminal being reversed in accordance with a shift direction controlled by a control signal. The display also includes an input switching unit that is disposed between the input terminal and the first and the second input/output terminals of the bi-directional common driver and that selectively inputs the input data from the input terminal to one of the first input/output terminal and the second input/output terminal and an output selecting unit that is disposed between the output terminal and the first and the second input/output terminals of the bi-directional common driver and that selectively leads and outputs the output data to the output terminal. The output data is output from one of the first and the second input/output terminals and the input data is input to the other of the first and the second input/output terminals by the input switching unit.

20 Claims, 4 Drawing Sheets

FOREIGN PATENT DOCUMENTS

| | | |
|---|---|---|
| JP | 2002-182614 | 6/2002 |
| JP | 2003-271109 | 9/2003 |

* cited by examiner

DRIVER FOR DRIVING A LIQUID CRYSTAL DISPLAY AND METHOD OF DRIVING THE SAME

BACKGROUND OF THE INVENTION

1. Field of the Invention

The present invention relates to a driver for driving a liquid crystal display and a method of driving the same, and more particularly to those enabling an input terminal and an output terminal for data to and from a bi-directional common driver to be fixed and further enabling a shift direction of data to be changed even after a liquid crystal display panel has been mounted.

2. Description of Related Art

Recently, mobile devices such as cellular phones has become very popular. A liquid crystal display (hereinafter, referred to as a LCD) used for such mobile devices, especially for cellular phones, includes a simple matrix type LCD, an active matrix type LCD, and so on. Pixels are lit by electrodes disposed on both vertical and horizontal sides in the simple matrix type LCD while an individual element corresponding to a pixel is turned "on" or "off" in the active matrix type LCD.

Furthermore, the active matrix type LCD includes a TFT (an abbreviation of thin film transistor) type LCD in which a transistor is provided on each pixel, a TFD (an abbreviation of thin film diode) type LCD in which a diode is provided on each pixel, and so forth. Since the TFD type LCD has similar contrast and color variation to the TFT type LCD and duplicates moving images and natural colors with low power consumption, it is expected that the TFD type LCD will be widely used for cellular phones or the like in the future.

Actually, when the LCD panel described above is mounted on a mobile device, as illustrated in FIG. 3, it is necessary to dispose, besides the LCD panel, a segment driver X (also referred to as X driver, hereinafter described as SEG driver) connected to a segment electrode of the LCD panel and a common driver Y (also referred to as Y driver, hereinafter described as COM driver) connected to a common electrode, in a housing. Specifically, in a cellular phone or the like, in view of a layout of a LCD display face on a surface of a housing, the SEG driver X is often disposed below the LCD panel, and the COM driver Y is often disposed on the left of the LCD panel (illustrated by a solid line in FIG. 3) or on the right thereof (illustrated by a chain double-dashed line in FIG. 3).

In order to display by scanning the LCD panel from the top to the bottom, if the COM driver Y is disposed on the left of the LCD panel, as will be understood from the later description, input data from the SEG driver X needs to be input to an input/output terminal DYIO1, and if the COM driver Y is disposed on the right thereof, the input data from the SEG driver needs to be input to input/output terminal DYIO2 since the COM driver Y is disposed upside down.

Accordingly, in order to scan the LCD panel sequentially from the top to the bottom irrespective of the position of the COM driver, (on the left or the right of the LCD panel), the COM driver should be bi-directional (two directions, one from a shift register output line 1 to a shift register output line 120, and the other from the shift register output line 120 to the shift register output line 1) so that a shift direction of the COM driver can be reversed.

In view of such a necessity, a bi-directional COM driver that enables the shift direction to be controlled by a control signal and has the first and the second input/output terminals DYIO1 and DYIO2 whose input/output relationship can be reversed in accordance with the shift direction has been developed.

FIGS. 4(*a*) and 4(*b*) show a bi-directional COM driver (a driver IC). The bi-directional COM driver incorporates a shift register circuit (not shown in the drawings) having a predetermined number (120, in the figure) of flip-flops. Accordingly, the bi-directional COM driver has 120 shift register output lines 1 through 120.

In addition, the bi-directional COM driver has the first and the second input/output terminals DYIO1 and DYIO2 whose input/output relationship is reversed in accordance with the shift direction controlled by a control signal SHF.

Therefore, if the shift direction is in a first direction shown in FIG. 4(*a*), the first input/output terminal DYIO1 becomes an input terminal to which input data is input and the second input/output terminal DYIO2 becomes an output terminal from which output data is output by applying, for example, a high level (hereinafter H level) signal to the bi-directional COM driver as the control signal SHF.

In this case, the bi-directional COM driver starts a data shift operation in response to the input data inputting to the first input/output terminal DYIO1, and then sequentially outputs shift data (corresponding to LCD scanning data) with the shift direction from the shift register output line 1 to the shift register output line 120. Then, the bi-directional COM driver outputs the output data from the second input/output terminal DYIO2 when a sequence of data shift to the output line 120 has finished.

If the shift direction is in a second direction as shown in FIG. 4(*b*), the first input/output terminal DYIO1 becomes the output terminal from which output data is output and the second input/output terminal DYIO2 becomes an input terminal to which input data is input by applying, for example, a low level (hereinafter L level) signal to the COM driver as the control signal SHF.

In this case, the bi-directional COM driver starts the data shift operation in response to the input data inputting to the second input/output terminal DYIO2, and then sequentially outputs shift data with the shift direction from the shift register output line 120 to the shift register output line 1. Then, the bi-directional COM driver outputs the output data from the first input/output terminal DYIO1 when a sequence of data shift to the output line 1 has finished.

However, when the above-mentioned bi-directional COM driver is disposed, for example, on the left of the LCD panel placed in a housing of a device (see, the arrangement illustrated by the solid line in FIG. 3.), in order to display by scanning the LCD panel from the top to the bottom, it is necessary to arrange the wiring so that the input data from the SEG driver X (the data providing a trigger for beginning the data shift operation) is supplied to the first input/output terminal DYIO1 placed in an upper position of the COM driver. Accordingly, since the position to which data is input from the SEG driver is fixed after the LCD panel has been mounted, the shift direction of the COM driver is fixed in a direction from the top to the bottom (in the case of the arrangement illustrated by the solid line in FIG. 3), so that the shift direction can not be changed after the LCD panel has been mounted. For example, when the LCD panel needs to be scanned from the bottom to the top, the wiring has to be changed so that the input data from the SEG driver is input to the second input/output terminal DYIO2, which is impossible after the LCD panel has been mounted.

In view of the above problem, the present invention is intended to provide a driver for driving an LCD and a driving method thereof that enable the input terminal and the output terminal for data to and from the bi-directional COM driver to be fixed as well as the shift direction of data to change even after the LCD panel has been mounted.

SUMMARY OF THE INVENTION

A driver for driving a liquid crystal display according to the present invention includes an input terminal that inputs input data, an output terminal that outputs output data, and a bi-directional common driver equipped with a first input/output terminal and a second input/output terminal. An input/output relationship of the first input/output terminal and the second input/output terminal is reversed in accordance with a shift direction controlled by a control signal. The driver also includes an input switching unit that is disposed between the input terminal and the first and the second input/output terminals of the bi-directional common driver and that selectively inputs the input data from the input terminal to one of the first input/output terminal and the second input/output terminal. The driver further includes an output selecting unit that is disposed between the output terminal and the first and the second input/output terminals of the bi-directional common driver and that selectively leads and outputs the output data to the output terminal. Here, the output data is output from one of the first and the second input/output terminals and the input data is input to the other of the first and the second input/output terminals by the input switching unit.

According to the above structure of the present invention, only by changing the instructions of the control signal with the input terminal and the output terminal for the data being fixed, it is possible to change the shift direction of the COM driver as well as to switch the input/output lines using the input switching unit and the output selecting unit. Thus, the shift direction can be easily changed only by the control signal even after the LCD panel has been mounted in the housing of the device. Moreover, since one of the output lines can be selected in accordance with the shift direction by using a selecting unit for selecting the output data as a data output unit of the COM driver, a problem can be prevented that an output from one of two lines for outputting data from the COM driver which does not function (the output is in a floating condition) shorts out with an output from the other of that which is selected and functions as an active output.

Furthermore, in the present invention, the input switching unit preferably includes a first switching unit that is disposed between the input terminal and the first input/output terminal of the bi-directional common driver and a second switching unit that is disposed between the input terminal and the second input/output terminal of the bi-directional common driver. The input switching unit preferably inputs the input data from the input terminal to the first input/output terminal by switching "on" the first switching unit if the shift direction controlled by the control signal is in a first direction. In addition, the input switching unit preferably inputs the input data from the input terminal to the second input/output terminal by switching "on" the second switching unit if the shift direction controlled by the control signal is in a second direction. Furthermore, the output selecting unit preferably includes a selector that is a two-input selector and that has a first input port connected to the first input/output terminal of the bi-directional common driver and a second input port connected to the second input/output terminal of the bi-directional common driver. The output selecting unit preferably outputs the output data from the second input/output terminal to the output terminal by selecting the second input port of the selector if the shift direction controlled by the control signal is in the first direction. In addition, the output selecting unit preferably outputs the output data from the first input/output terminal to the output terminal by selecting the first input port of the selector if the shift direction controlled by the control signal is in the second direction.

According to the above structure, the first and the second switching unit are switched "on" and "off" or switched "off" and "on", respectively, at the same time the output line is accordingly selected by the selector, in sync with switching of the shift direction of the COM driver controlled by the control signal. Thus, the input and the output terminals can be easily switched with the input and the output terminals for data being fixed.

Furthermore, a driving method of a driver for driving a liquid crystal display according to the present invention includes the steps of providing an input terminal that inputs input data, providing an output terminal that outputs output data, and providing a bi-directional common driver equipped with a first input/output terminal and a second input/output terminal. An input/output relationship of the first input/output terminal and the second input/output terminal is reversed in accordance with a first direction and a second direction of a shift direction controlled by a control signal. The driving method also includes the steps of providing an input switching unit that selectively inputs the input data from the input terminal to one of the first input/output terminal and the second input/output terminal and providing an output selecting unit that selectively leads and outputs the output data to the output terminal. Here, the output data is output from one of the first and the second input/output terminals and the input data is input to the other of the first and the second input/output terminals by the input switching unit. In addition, the driving method also includes the steps of inputting the input data from the input terminal to the first input/output terminal of the bi-directional common driver if the shift direction controlled by the control signal is in the first direction and outputting the output data from the second input/output terminal of the bi-directional common driver to the output terminal if the shift direction controlled by the control signal is in the first direction. The driving method further includes the steps of inputting the input data from the input terminal to the second input/output terminal of the bi-directional common driver if the shift direction controlled by the control signal is in the second direction and outputting the output data from the first input/output terminal of the bi-directional common driver to the output terminal if the shift direction controlled by the control signal is in the second direction.

According to the above driving method of the present invention, only by changing the instructions of the control signal with the input terminal and the output terminal of data being fixed, it is possible to change the shift direction of the COM driver as well as to switch the input/output lines using the input switching unit and the output selecting unit. Thus, the shift direction can be easily changed only by the control signal even after the LCD panel has been mounted. Moreover, since one of the output lines can be selected in accordance with the shift direction by using a selecting unit for selecting output data as a data output unit of the COM driver, a problem can be prevented that an output from one of two lines for outputting data from the COM driver which does not function (the output is in a floating condition) shorts out with an output from the other of that which is selected and functions as an active output.

DETAILED DESCRIPTION OF THE PREFERRED EMBODIMENTS

The preferred embodiments of the present invention will be hereinafter explained referring to the accompanying drawings.

Figure 1:
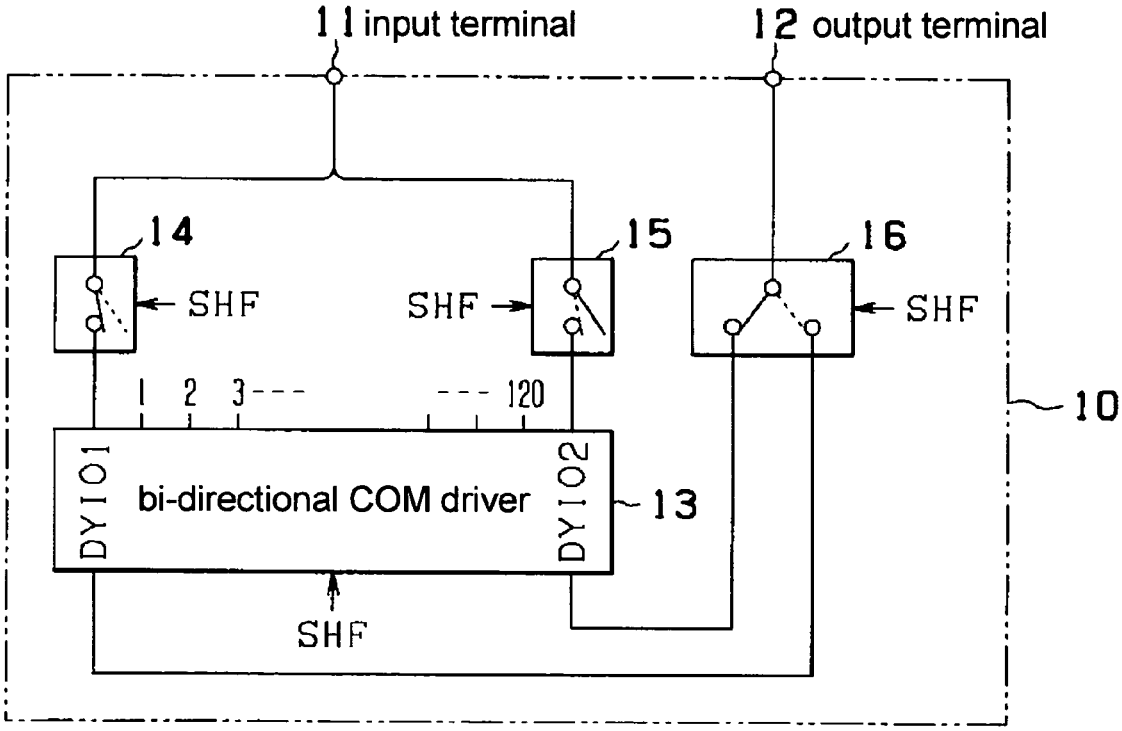
FIG. 1 is a block diagram showing a driver for a liquid crystal display according to an embodiment of the present invention.

FIG. 1 shows a block diagram illustrating a driver for driving a liquid crystal display (LCD) according to an embodiment of the present invention.

A driver for driving a LCD 10 shown in FIG. 1 includes an input terminal 11 that inputs input data sent from a SEG driver not shown in the figure and indicating the beginning of a data shift operation, and an output terminal 12 that outputs output data indicating the completion of a series of the data shift operation (e.g. the data shift operation of one scanning line). The driver for driving the LCD 10 also includes a bi-directional COM driver 13 that has a first input/output terminal DYIO1 and a second input/output terminal DYIO2. An input/output relationship of the first and the second input/output terminals DYIO1 and DYIO2 is reversed in accordance with a shift direction controlled by a control signal SHF supplied from a control circuit not shown in the figure. In addition, the driver for driving the LCD 10 also includes an input switching unit that has a first switching circuit 14 and a second switching circuit 15 that are disposed between the input terminal 11 and the first input/output terminal DYIO1 and between the input terminal 11 and the second input/output terminal DYIO2, respectively, and that can selectively input the data from the input terminal 11 to one of the first and the second input/output terminals DYIO1 and DYIO2. Furthermore, the driver for driving the LCD 10 includes an output selecting unit that has a selector 16 that is a two-input selector, that is disposed between the output terminal 12 and the first and the second input/output terminals DYIO1 and DYIO2 of the bi-directional COM driver 13, and that leads and outputs the output data. Here, the output data is output from one of the first and the second input/output terminals DYIO1 and DYIO2 and the input data is input to the other of the first and the second input/output terminals DYIO1 and DYIO2 through the input switching unit to the output terminal 12.

In addition, the driver for driving the LCD 10 preferably has the input terminal 11 and the output terminal 12. Furthermore, the bi-directional COM driver 13, the first switching circuit 14, the second switching circuit 15, and the selector 16 are preferably integrated as one IC circuit.

Figure 4A:
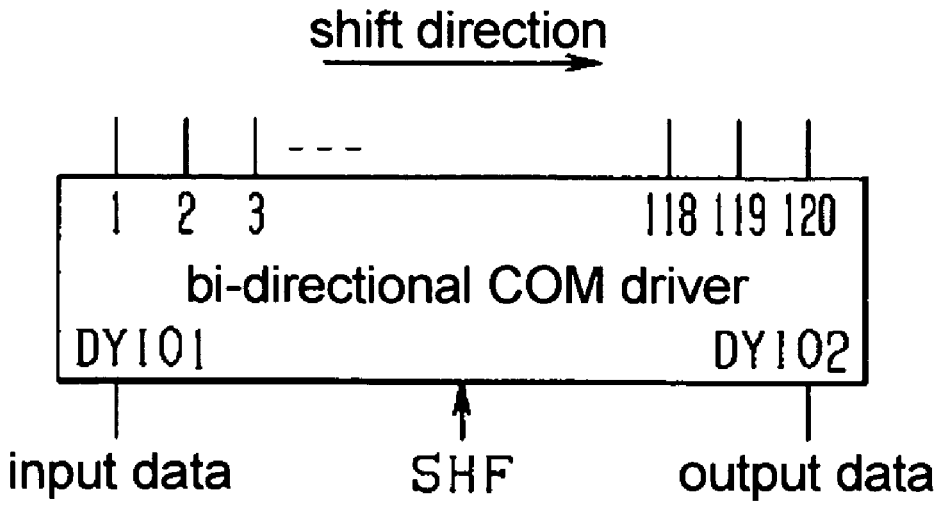
FIGS. 4(*a*) and 4(*b*) are schematic views of a bi-directional COM driver illustrating an input/output relationship and a shift direction.
Figure 4B:
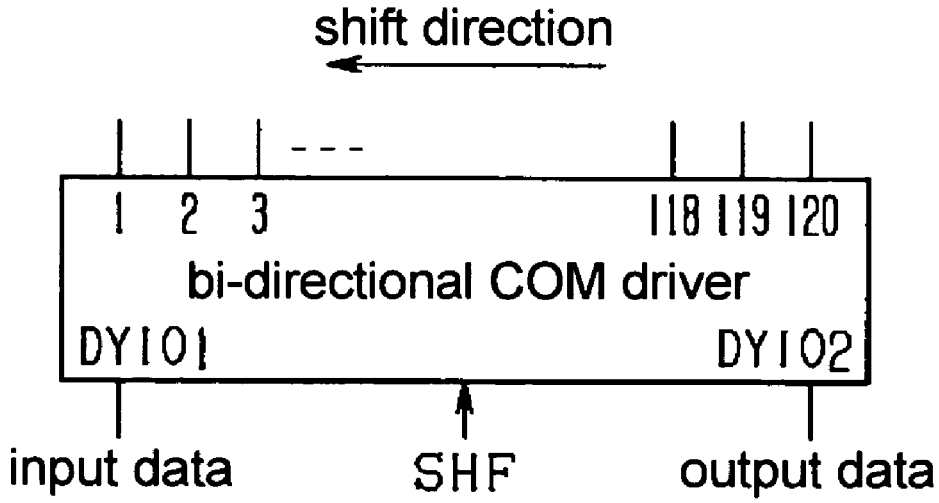

Although the bi-directional COM driver 13 is similar to a conventional bi-directional COM driver shown in FIG. 4, other elements: the input terminal 11; the output terminal 12; the input switching unit that includes the first and the second switching circuits 14 and 15; and the output selecting unit that includes the selector 16 are newly provided in the embodiment of the present invention as an original element.

The bi-directional COM driver 13 incorporates a shift register circuit not shown in the figure that has a predetermined number of flip-flops (120, in the figure) and has 120 shift register output lines 1 through 120 each connected to the output terminal of each of the flip-flops.

In the bi-directional COM driver 13, the input/output relationship of the first and the second input/output terminals DYIO1 and DYIO2 is reversed in accordance with a H and a L level of the control signal SHF supplied from the control circuit not shown in the figure, as previously mentioned. Namely, if the control signal SHF is at a H level, the first input/output terminal DYIO1 becomes the input terminal to which the input data is input, and the second input/output terminal DYIO2 becomes the output terminal from which the output data is output. On the contrary, if the control signal SHF is at a L level, the first input/output terminal DYIO1 becomes the output terminal from which the output data is output, and the second input/output terminal DYIO2 becomes the input terminal to which the input data is input. In other words, in accordance with the H and the L levels of the control signal SHF, the shift direction is switched between the first shift direction i.e., from the output line 1 to the output line 120 and the second shift direction i.e., from the output line 120 to the output line 1.

The input switching unit includes the first switching circuit 14 that is disposed between the input terminal 11 and the first input/output terminal DYIO1 of the bi-directional COM driver 13 and is switched "on" if the control signal SHF is at a H level, and the second switching circuit 15 that is disposed between the input terminal 11 and the second input/output terminal DYIO2 of the bi-directional COM driver 13 and is switched "on" if the control signal SHF is at a L level. If the control signal SHF is at a H level and the shift direction is in the first direction, the first switching circuit 14 is switched "on", causing the input data from the input terminal 11 to be input to the first input/output terminal DYIO1, while if the control signal SHF is at a L level and the shift direction is in the second direction, the second switching circuit 15 is switched "on", causing the input data from the input terminal 11 to be input to the second input/output terminal DYIO2.

The output selecting unit includes the selector 16 that is a two-input selector and that has a first input port "a" connected to the first input/output terminal DYIO1 of the bi-directional COM driver 13 and a second input port "b" connected to the second input/output terminal DYIO2 of the bi-directional COM driver 13. If the control signal SHF is at a H level and the shift direction is in the first direction, the second input port "b" of the selector 16 is selected, causing the output data from the second input/output terminal DYIO2 to be output to the output terminal 12, while if the control signal SHF is at a L level and the shift direction is in the second direction, the first input port "a" of the selector 16 is selected, causing the output data from the first input/output terminal DYIO1 to be output to the output terminal 12.

Note that in FIG. 1 the solid line and the broken line illustrate operational positions of sliding reeds of the first and the second switching circuits 14 and 15, and the selector 16, where the solid line corresponds to the H level of the control signal SHF while the broken line corresponds to the L level.

In the driver for driving the LCD 10 formed as the above, if the control signal SHF is at a H level, the circuit shown in FIG. 1 becomes equivalent to a structure shown in FIG.

2(*a*) because the shift direction of the bi-directional COM driver 13 is set to the first direction i.e., from the output line 1 to the output line 120, the first switching circuit 14 is switched "on", and the second input port "b" of the selector 16 is selected. Accordingly, the input data supplied from the SEG driver not shown in the figure to the input terminal 11 is input to the first input/output terminal DYIO1 of the bi-directional COM driver 13 and the output data output from the second input/output terminal DYIO2 is output to the output terminal 12.

Figure 2A:
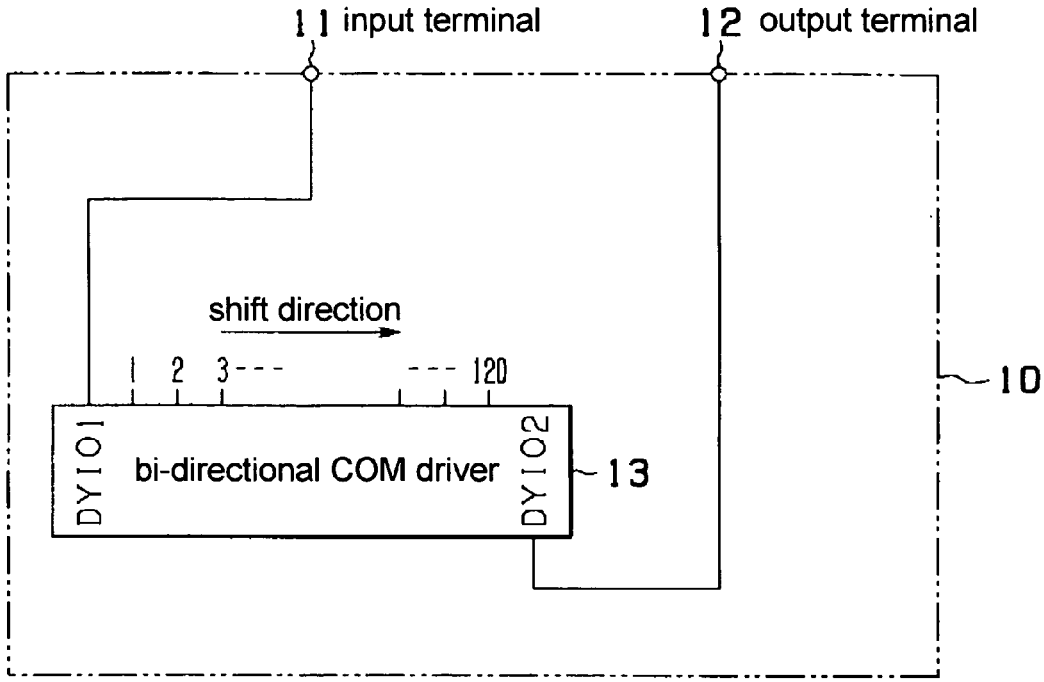
FIGS. 2(*a*) and 2(*b*) are block diagrams showing structures equivalent to the structure shown in FIG. 1 if the control signal SHF is at a H and a L level, respectively.
Figure 2B:
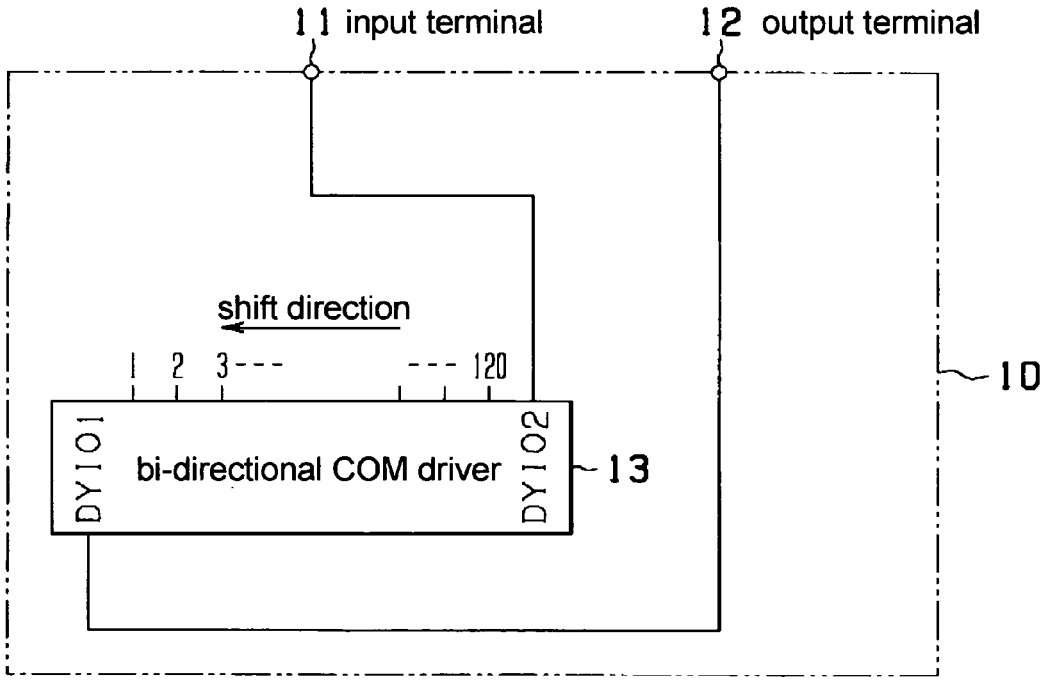
Figure 3:
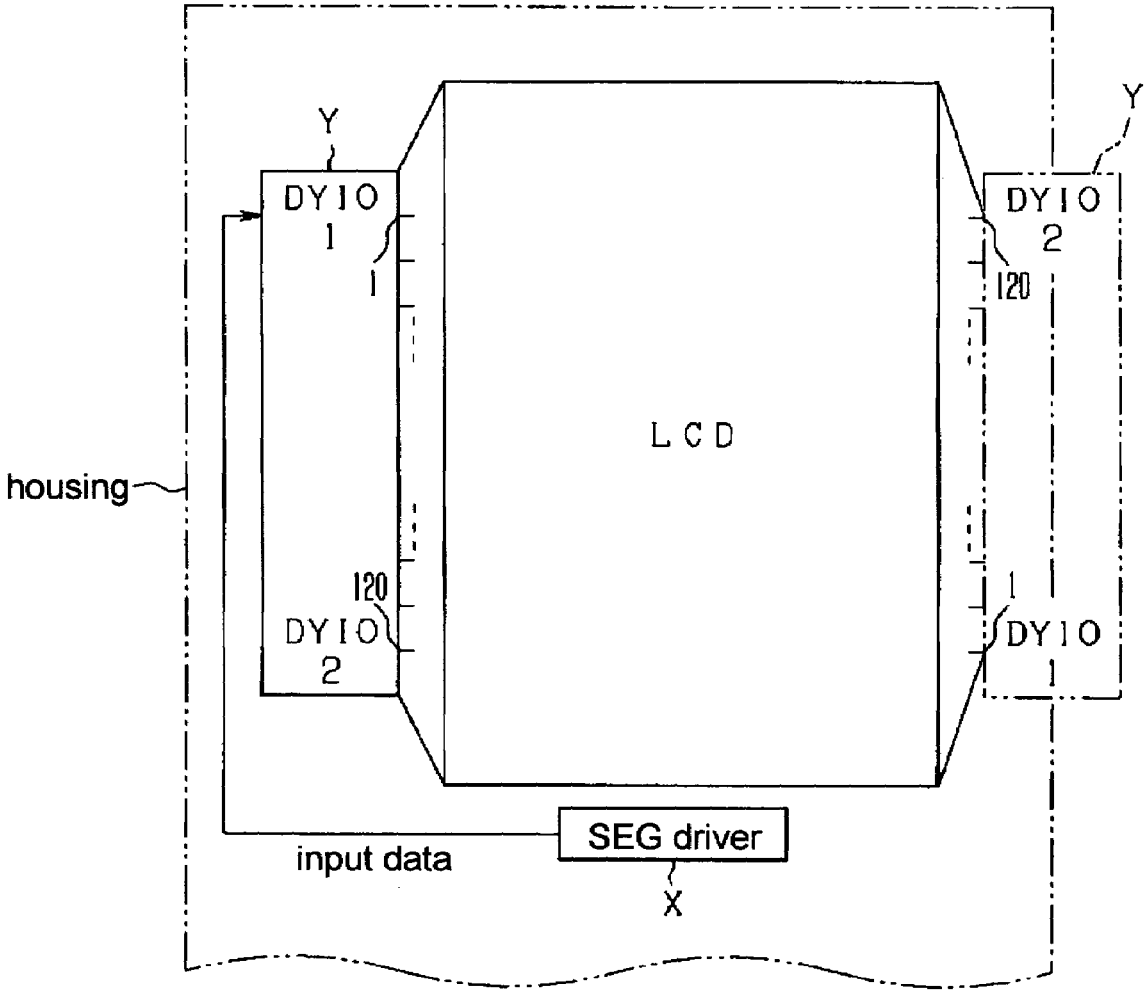
FIG. 3 is a schematic view of a mobile device illustrating an arrangement of a LCD panel, a SEG driver, and a COM driver in a housing of the mobile device.

Furthermore, if the control signal SHF is at a L level, the circuit shown in FIG. 1 becomes equivalent to a structure shown in FIG. 2(*b*) because the shift direction of the bi-directional COM driver 13 is set to the second direction i.e., from the output line 120 to the output line 1, the second switching circuit 15 is switched "on", and the first input port "a" of the selector 16 is selected. Accordingly, the input data supplied from the SEG driver not shown in the figure to the input terminal 11 is input to the second input/output terminal DYIO2 of the bi-directional COM driver 13 and the output data output from the first input/output terminal DYIO1 is output to the output terminal 12.

According to the above, only by changing the instructions of the control signal with the input terminal and the output terminal for data being fixed, it is possible to change the shift direction of the COM driver as well as to switch the input/output lines using the input switching unit and the output selecting unit. Thus, the shift direction can be easily changed only by the control signal even after the LCD panel has been mounted. Moreover, since one of the output lines can be selected in accordance with the shift direction by using the two-input selector for selecting the output data as a data output circuit of the COM driver, the problem can be prevented that an output from one of the two lines for outputting data from the COM driver which does not function (the output is in a floating condition) shorts out with an output from the other of that which is selected and functions as an active output.

The present invention is not limited to the above embodiments but applied to various kinds of modifications without departing from the spirit and the scope of the present invention.

According to the present invention, the data shift direction can be bi-directionally changed by the control signal while fixing the input terminal and the output terminal for data to and from the COM driver. Therefore, the shift direction can be changed after the LCD panel has been mounted without changing the connection of the wiring for supplying input data.

What is claimed is:

1. A driver for driving a liquid crystal display, comprising:

an input terminal that inputs input data;

an output terminal that outputs output data;

a bi-directional common driver equipped with a first input/output terminal and a second input/output terminal, an input/output relationship of the first input/output terminal and the second input/output terminal being reversed in accordance with a shift direction controlled by a control signal;

means for switching that is disposed between the input terminal and the first and the second input/output terminals of the bi-directional common driver and that selectively inputs the input data from the input terminal to one of the first input/output terminal and the second input/output terminal; and means for switching that is disposed between the output terminal and the first and the second input/output terminals of the bi-directional common driver and that selectively leads and outputs the output data to the output terminal, the output data being output from one of the first and the second input/output terminals and the input data being input to the other of the first and the second input/output terminals by the means for switching.

2. The driver for driving a liquid crystal display according to claim 1, wherein the means for switching includes a first switching circuit that is disposed between the input terminal and the first input/output terminal of the bi-directional common driver and a second switching circuit that is disposed between the input terminal and the second input/output terminal of the bi-directional common driver.

3. A method of driving a driver of a liquid crystal display, comprising:

providing an input terminal that inputs input data;

providing an output terminal that outputs output data;

providing a bi-directional common driver equipped with a first input/output terminal and a second input/output terminal, an input/output relationship of the first input/output terminal and the second input/output terminal being reversed in accordance with a first direction and a second direction of a shift direction controlled by a control signal;

providing an input switching unit that selectively inputs the input data from the input terminal to one of the first input/output terminal and the second input/output terminal; and providing an output selecting unit that selectively leads the output data to the output terminal, the output data being output from one of the first and the second input/output terminals and the input data being input to the other of the first and the second input/output terminals by the input switching unit.

4. The driver for driving a liquid crystal display according to claim 2 wherein the means for switching inputs the input data from the input terminal to the first input/output terminal by switching "on" the first switching circuit if the shift direction controlled by the control signal is in a first direction.

5. The driver for driving a liquid crystal display according to claim 2 wherein the means for switching inputs the input data from the input terminal to the second input/output terminal by switching "on" the second switching circuit if the shift direction controlled by the control signal is in a second direction.

6. The driver for driving a liquid crystal display according to claim 1 wherein the means for switching includes a selector that is a two-input selector and that has a first input port connected to the first input/output terminal of the bi-directional common driver and a second input port connected to the second input/output terminal of the bi-directional common driver.

7. The driver for driving a liquid crystal display according to claim 1 wherein the means for switching outputs the output data from the second input/output terminal to the output terminal by selecting the second input port of the selector if the shift direction controlled by the control signal is in the first direction.

8. The driver for driving a liquid crystal display according to claim 1 wherein the means for switching outputs the output data from the first input/output terminal to the output terminal by selecting the first input port of the selector if the shift direction controlled by the control signal is in the second direction.

9. A driver for driving a liquid crystal display, comprising:

an input terminal that inputs input data;

an output terminal that outputs output data;

a bi-directional common driver equipped with a first input/output terminal and a second input/output terminal, an input/output relationship of the first input/output terminal and the second input/output terminal being reversed in accordance with a shift direction controlled by a control signal;

an input switching unit that is disposed between the input terminal and the first and the second input/output terminals of the bi-directional common driver and that selectively inputs the input data from the input terminal to one of the first input/output terminal and the second input/output terminal; and an output selecting unit that is disposed between the output terminal and the first and the second input/output terminals of the bi-directional common driver and that selectively leads and outputs the output data to the output terminal, the output data being output from one of the first and the second input/output terminals and the input data being input to the other of the first and the second input/output terminals by the input switching unit.

10. The driver for driving a liquid crystal display according to claim 9, wherein the input switch unit includes a first switching circuit that is disposed between the input terminal and the first input/output terminal of the bi-directional common driver and a second switching circuit that is disposed between the input terminal and the second input/output terminal of the bi-directional common driver.

11. The driver for driving a liquid crystal display according to claim 10 wherein the input switching unit inputs the input data from the input terminal to the first input/output terminal by switching "on" the first switching circuit if the shift direction controlled by the control signal is in a first direction.

12. The driver for driving a liquid crystal display according to claim 10 wherein the input switching unit inputs the input data from the input terminal to the second input/output terminal by switching "on" the second switching circuit if the shift direction controlled by the control signal is in a second direction.

13. The driver for driving a liquid crystal display according to claim 9 wherein the output selecting unit includes a selector that is a two-input selector and that has a first input port connected to the first input/output terminal of the bi-directional common driver and a second input port connected to the second input/output terminal of the bi-directional common driver.

14. The driver for driving a liquid crystal display according to claim 9 wherein the output selecting unit outputs the output data from the second input/output terminal to the output terminal by selecting the second input port of the selector if the shift direction controlled by the control signal is in the first direction.

15. The driver for driving a liquid crystal display according to claim 9 wherein the output selecting unit outputs the output data from the first input/output terminal to the output terminal by selecting the first input port of the selector if the shift direction controlled by the control signal is in the second direction.

16. The method of driving a liquid crystal display according to claim 3 further comprising inputting the input data from the input terminal to the first input/output terminal of the bi-directional common driver if the shift direction controlled by the control signal is in the first direction.

17. The method of driving a liquid crystal display according to claim 3 further comprising outputting the output data from the second input/output terminal of the bi-directional common driver to the output terminal if the shift direction controlled by the control signal is in the first direction.

18. The method of driving a liquid crystal display according to claim 3 further comprising inputting the input data from the input terminal to the second input/output terminal of the bi-directional common driver if the shift direction controlled by the control signal is in the second direction.

19. The method of driving a liquid crystal display according to claim 3 further comprising outputting the output data from the first input/output terminal of the bi-directional common driver to the output terminal if the shift direction controlled by the control signal is in the second direction.

20. The method of driving a liquid crystal display according to claim 3 further comprising providing a selector that is a two-input selector and that has a first input port connected to the first input/output terminal of the bi-directional common driver and a second input port connected to the second input/output terminal of the bi-directional common driver.

* * * * *